US006502494B2

(12) United States Patent
Marshall

(10) Patent No.: US 6,502,494 B2
(45) Date of Patent: Jan. 7, 2003

(54) MULTI-RAILGUN SYSTEM USING THREE PHASE ALTERNATING CURRENT

(76) Inventor: Richard A Marshall, 11609 Fence Post Trail, Austin, TX (US) 78750

( * ) Notice: Subject to any disclaimer, the term of this patent is extended or adjusted under 35 U.S.C. 154(b) by 65 days.

(21) Appl. No.: 09/752,218

(22) Filed: Dec. 29, 2000

(65) Prior Publication Data

US 2002/0178899 A1 Dec. 5, 2002

Related U.S. Application Data

(60) Provisional application No. 60/174,467, filed on Dec. 30, 1999.

(51) Int. Cl.[7] ..... F41B 6/00

(52) U.S. Cl. ..... 89/8

(58) Field of Search ..... 89/8

(56) References Cited

U.S. PATENT DOCUMENTS

| | | | | | |
|---|---|---|---|---|---|
| 1,370,200 | A | * | 3/1921 | Fauchon-Villeplee | 89/8 |
| 3,382,387 | A | | 5/1968 | Marshall | 310/219 |
| 3,589,300 | A | * | 6/1971 | Wipf | 89/8 |
| 4,319,168 | A | * | 3/1982 | Kemeny | 89/8 |
| 4,718,322 | A | * | 1/1988 | Honig et al. | 89/8 |
| 4,754,687 | A | * | 7/1988 | Kemeny | 89/8 |
| 4,967,639 | A | * | 11/1990 | Hughes et al. | 89/8 |
| 4,987,821 | A | * | 1/1991 | Kemeny et al. | 89/8 |
| 5,183,956 | A | * | 2/1993 | Rosenberg | 89/8 |
| 5,540,134 | A | | 7/1996 | Bird, Jr. | 89/8 |
| 5,944,311 | A | | 8/1999 | Hartzell | 273/156 |

FOREIGN PATENT DOCUMENTS

| | | | | |
|---|---|---|---|---|
| DE | 37 16 078 A1 | * | 5/1987 | 89/8 |

OTHER PUBLICATIONS

W.H. Bostick, *Propulsion of Plasma by Magnetic Means*, Peaceful Uses of Atomic Energy, Proc. 2nd UN Int. Conf., vol. 32, pp 427–430, 1958.

Marshall, R.A., "The Australian National University Rail Gun Project", Atomic Energy, pp. 16–19, Jan. 1975.

Marshall, R.A., "The Rail Gun Installation", The Preceedings of an Australian—US Seminar on Energy Storage, Compression and Switching High Power High Energy Pulse Production and Application, pp. 211–223, Nov. 1977.

Marshall, R.A., "Moving Contacts in Macro–Particle Accelerators", The Australian National University pp. 269–283, No date.

Marshall, R.A., and W.F. Weldon, "Analysis of Performance of Rail Gun Accelerators Powered by Distributed Energy Sources" Center for Electromechanics, The University of Texas at Austin. pp. 1–5, 1980.

Marshall, R.A., "Design for Brush Gear for High Current Pulses and High Rubbing Velocities", IEEE Transactions on Power Apparatus and Systems, vol. PAS–85, No. 11, pp. 1177–1188, Nov. 1966.

Marshall, R.A. "Copper Graphite Brushes for Very High Current Density", The Australian—US Seminar on Energy Storage, Compression and Switching; The Australian Commonwealth Department of Science and the National Science Foundation of America, pp. 196–200, Nov. 1977.

* cited by examiner

*Primary Examiner*—Stephen M. Johnson
(74) *Attorney, Agent, or Firm*—Baker Botts L.L.P.

(57) ABSTRACT

A railgun accelerator system powered by alternating current (AC) is disclosed. In one form, the system advantageously uses multiples of six railguns in parallel, allowing velocities of around 100 miles per hour to be imparted to a carriage of mass around 6000 pounds. Three phase AC power from a domestic grid or from a similar source may feed multiple power points along the length of the accelerator.

11 Claims, 11 Drawing Sheets

MULTI-RAILGUN SYSTEM USING THREE PHASE ALTERNATING CURRENT

RELATED PATENT APPLICATION

This application claims the benefit of U.S. Provisional Application No. 60/174,467, filed Dec. 30, 1999, now abandoned and entitled "Multi-Railgun System Using Three Phase Alternating Current".

TECHNICAL FIELD

The present invention is related to railguns and specifically to railguns powered by three phase alternating electrical current.

BACKGROUND OF THE INVENTION

Railgun macroparticle accelerators have presently impart high velocities (3 km/s and up) to launch packages or payloads with masses of a few grams to a few kilograms. There is now a large body of literature published giving details of what is required to do this. Some commercial and military applications desire launching masses of thousands of kilograms to velocities of approximately 100 m/s or so. One commercial application imparts velocities of approximately 100 miles per hour (45 m/s) to a carriage of mass 6000 pounds in the "Superman" ride at Magic Mountain, Valencia, Calif. Several military applications include launching of aircraft and "glide bombs" from naval ships and other sites such as ground based platforms.

FIG. 1 illustrates the general principal of a conventional railgun. During operation, electric current conducts through one rail 1 along the armature 2 and back to the power supply through the second rail 3. Current flow is indicated by arrows drawn on the rails. The current in the rails produces magnetic fields shown as dashed ellipses 4 in FIG. 1. The current in the armature 2 interacts with this magnetic field to give the electromagnetic (EM) railgun force on the armature 2. The force F is generated outward regardless of current flow direction.

The railgun described herein is sometimes referred to as the "Bostic railgun". The formula for calculating the railgun force, F, is:

$$F=\tfrac{1}{2}L'I^2$$

where I is the current and L' is the inductance gradient of the rail pair. The force is in Newtons when current is in amperes and L' is in Henries per meter. Note that typically L' is a very small number, around $0.5\times10^{-6}$ H/m, in some conventional applications. As such, large currents are needed to generate reasonable forces.

Two types of railgun applications include "high velocity" and "low velocity" railguns. The operating principle of both of them are substantially the same but their physical form and the means of delivering electric power to them can be quite different. High velocity railguns tend to be short with lengths of a few meters and short acceleration times of around one hundredth of a second. The accelerating current must be pretty much unidirectional because the "coasting time" at current reversal, if alternating current (AC) is used, is undesirable and leads to wasted gun length during launch. Low velocity railguns have much greater lengths and have acceleration times measured in seconds. Their allowable accelerations will be much lower because their launch packages include delicate components such as passengers.

The mechanical arrangement of a simple railgun is illustrated in FIGS. 2 and 3. The rails 5 are parallel and the launch package 6 and armature 7 are positioned between each rail. Rail support means and launch package guidance means are indicated at 8 as shown by the cutaway. Electrical connections are made at the breech end 9 of the rails. As is described in the case of the Bostic railgun, current goes up one rail, across the armature, and back down the other rail, as indicated by the larger arrows 10. The railgun bore is shown as roughly square but it can be many different geometric shapes such as, rectangular, round, etc.

The directions of the EM forces are shown by the small arrows in FIG. 3 which is a plan view of the railgun. As well as driving the launch package or payload, the EM forces load the sliding contacts between the ends of the armature arms 11 and the rails 5. Such loading is helpful in providing non-sparking contacts between the arm ends and the rails. Armatures are usually "sprung" between the rails to provide mechanical preloading as part of the required contact force. Electromagnetic forces also act to push the rails apart, an effect that must be resisted by the rails support structure.

SUMMARY OF THE INVENTION

In accordance with teachings of the present disclosure, a multi-railgun system using three phase alternating current is disclosed. In one form, a system operable to displace an object is provided. The system includes a housing having a pair of rails operable to conduct a current and an armature coupled between the rails and operable to conduct the current between the rails. The system includes a thrust arm coupled to the armature and extending through a slot in the housing. The thrust arm is operable to displace the object in response to the armature conducting the current and moving along the rails.

According to another aspect of the invention, a railgun accelerator system is disclosed. The system includes a plurality of railguns having a pair of rails operable to conduct a current and an armature positioned between the rails and operable to be displaced along the rails in response to the current. The system further includes distributed power sources positioned along the rails and operable to provide a single phase alternating current for each railgun.

According to a further aspect of the invention, a railgun acceleration system operable to displace an object is disclosed. The system includes a plurality of railguns having a pair of rails wherein each railgun is operable to conduct an associated single phase alternating current of a three phase alternating current. The system further includes a plurality of armatures positioned between the rails and operable to be displaced along the rails in response to the current and a thrust arm coupled to each armature and operable to displace the object.

One technical advantage of the present invention includes using three phase alternating current to produce a ripple free driving force for a railgun. As such, simplified embodiments for switching a railgun current "on" and "off" may be provided.

Another technical advantage of the present invention is to provide a railgun having plural stages. Each stage may provide a single phase of alternating current for each railgun to displace an object via thrust arms coupled to each railgun. Through using a single phase for each railgun, a substantially constant force may be realized for displacing the object.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
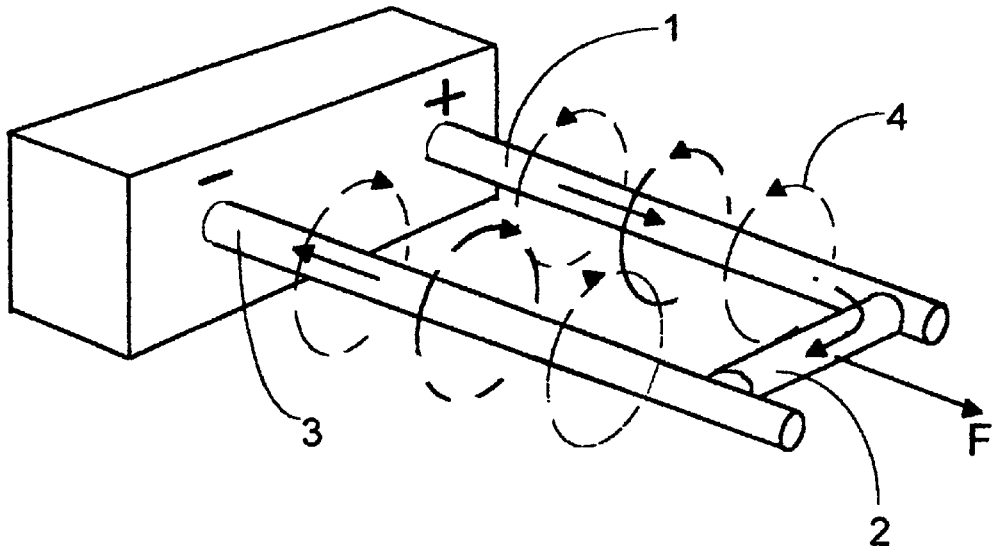
FIG.1. (Prior art)
FIG. 1 is a general illustration of the railgun principal.
Figure 2:
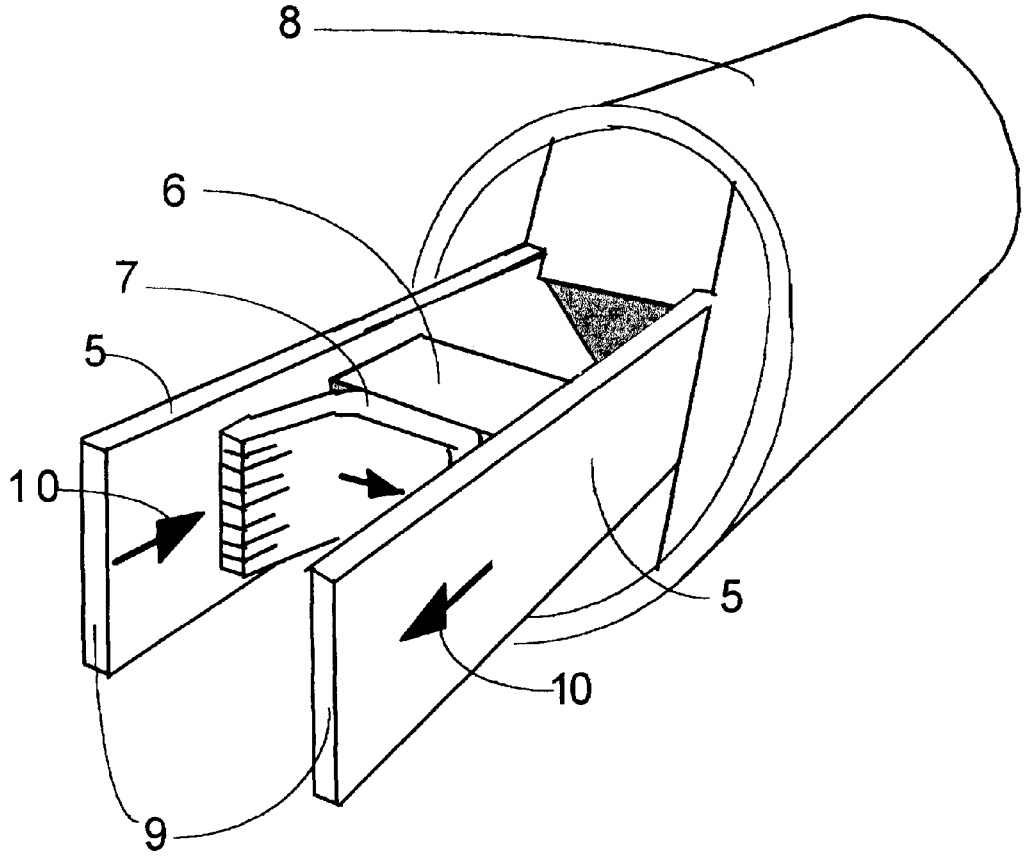
FIG. 2. (Prior art)
FIG. 2 illustrates a perspective view of a conventional railgun assembly.
Figure 3:
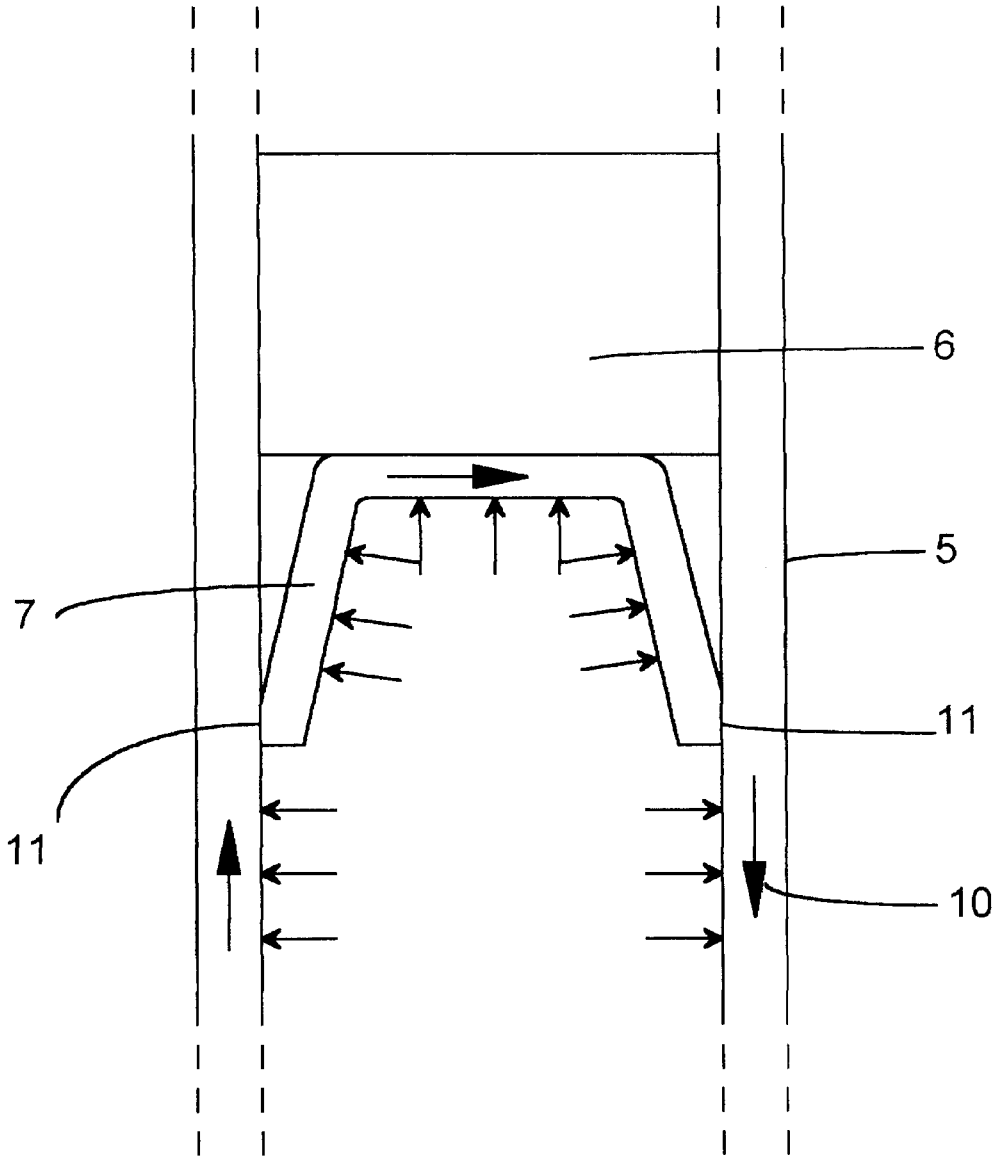
FIG. 3. (Prior art)
FIG. 3 illustrates a top view of the railgun illustrated in FIG. 2.
Figure 4:
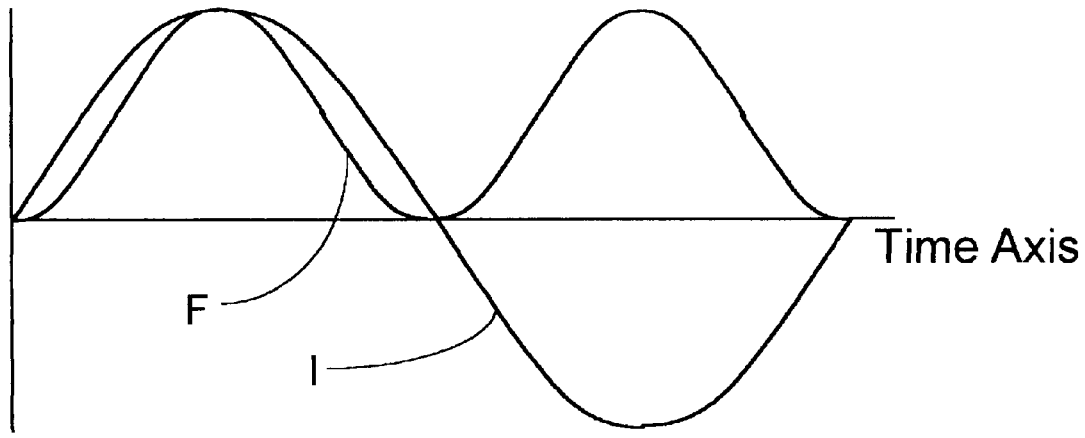
FIG. 4 is a graphic illustration generally describing a current and force relationship in an AC powered railgun.

Preferred embodiments of the invention and its advantages are best understood by reference to FIGS. 4–11. The present invention provides multiple phase AC powered railguns operable to displace an object. In one form, the multiple phase AC powered railguns include a series of stages operable to provide a single phase to an armature. As such, a substantially constant force may be produced through reducing undesirable ripple effects produced by single phase AC powered railguns. For example, FIG. 4 illustrates one short coming of using single phase AC to drive a railgun. The force F is proportional to current squared and remains positive and sinusoidal with double the frequency of the current sine wave. As the force F rises from zero to maximum and back twice every current cycle, a large "ripple" in the force results.

The present invention advantageously provides multi-phased AC power to reduce the "ripple" effect caused by single phase AC power. For example, three force curves F (not expressly shown) may be provided with their phase angles 120 degrees apart through using three phase AC power. As such, three force curves F may provide a substantially constant value equal to three times the mean value of one of the F curves thereby substantially reducing ripple in the resultant total force.

Figure 5:
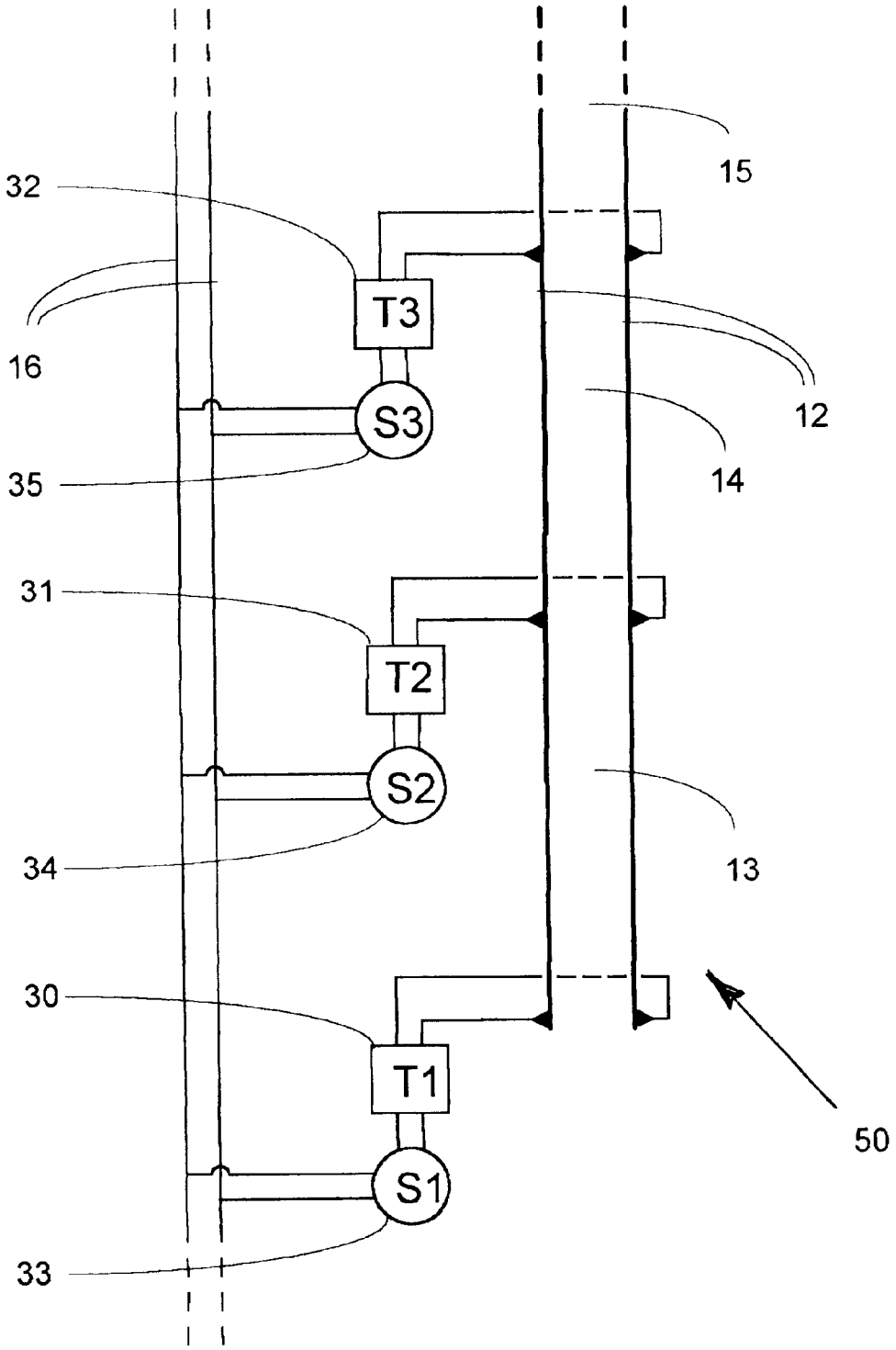
FIG. 5 illustrates one embodiment of a single phase AC powered railgun according to teachings of the present invention.

FIG. 5 illustrates one embodiment of a single phase AC powered railgun. A railgun, illustrated generally at 50, includes a pair of rails 12 having a first stage 13, a second stage 14 and a third stage 15. AC power may be provided using power lines 16 coupled to each stage of railgun 50. First stage 13 is coupled to power lines 16 using first stage transformer 30 and first stage switch 33, second stage 14 is coupled to power lines 16 using second stage transformer 31 and second stage switch 34, and third stage 15 is coupled to power lines 116 using third stage transformer 32 and third stage switch 35. Railgun 50 may also include additional stages as needed. In one embodiment, power lines 16 may be a pair of high tension AC power lines and may be electrically connected to railgun 50 using matching voltage step-down (current step-up) transformers for transformers 30, 31, and 32.

During operation, acceleration begins with the armature and thrust block (not expressly shown) at rest at the beginning of first stage 13. When first stage switch 33 is closed, acceleration of the armature begins. As the armature moves into secondary stage 14, second stage switch 34 closes and shortly thereafter first stage switch 33 opens to prevent current from second stage transformer 31 from shunting back down railgun 50. Switching transformers continues in like manner as the armature enters subsequent stages and accelerates along rails 12. As such, through using single phase AC power, opening and closing of switches 33, 34, and 35 within plus or minus a few cycles maintains optimal performance of railgun 50 thereby reducing critical timing which may be required for accelerating an object. For example, power to an active stage remains switched "on" until the armature enters the next stage, at which time power in the next stage is switched "on" and power to the previous stage is switched "off".

In one embodiment, as the velocity of the armature and thrust arm increases (not expressly shown), higher voltage may be required to maintain an operating current reasonably constant. As such, each transformer secondary for transformers 30, 31, and 32 may have higher output voltages at higher stage numbers.

In one embodiment, standard commercial AC circuit breakers may be used to switch the AC power for each stage. Matching between the stages may be achieved using transformers and power may be provided to each stage using much higher voltage than required by railgun 50. As such, switches 33, 34, and 35 may be positioned on the primary side of the transformers due to current being lower on the primary side.

Figures 6A, 6B:
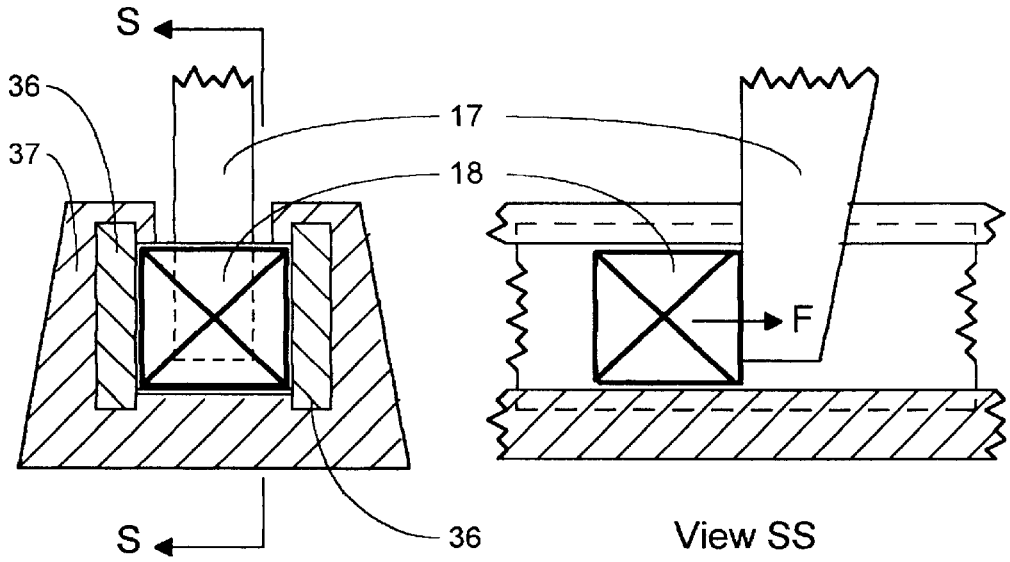
FIG. 6A illustrates a rear perspective view of one embodiment of a single phase AC powered railgun according to teachings of the present invention.
FIG. 6B illustrates a side perspective view of one embodiment of a single phase AC powered railgun according to teachings of the present invention.

FIG. 6A and 6B illustrate a rear and side perspective view of a single phase AC powered railgun according to one embodiment of the present invention. A low velocity railgun is illustrated and includes a pair of rails 36 coupled to a housing 37. An armature 18 is positioned between rails 36 and is operable to displace an object (not expressly shown) using thrust arm 17. Housing 37 includes a continuous slot in the top portion of housing 37 to allow thrust arm 17 to provide a force F to a payload or object external to the railgun.

In one embodiment, housing 37 may be cantilevered from the base to offset the EM repulsion force between rails 36. Housing 37 may be arranged such that rails 36 are positively located by the recesses within housing 37 and through use of an upper lip along the top portion of rails 36. Additionally, the base of housing 37 and the lower surfaces of the upper lips of housing 37 provide guidance surfaces for armature 18.

During use, a single phase of multiple phase AC power may be provided to rails 36 at distributed points along rails 36 (not expressly shown). Armature 18 moves along rails 36 and provides a force to thrust arm 17 to displace an object or payload. In one embodiment, three-phase AC-power may be selectively coupled to rails 36 to provide a current having a phase which is approximately 120° apart from an associated railgun (not expressly shown). As such, a substantially constant force F may be provided by armature 18 to displace an object via thrust arm 17.

Figure 7:
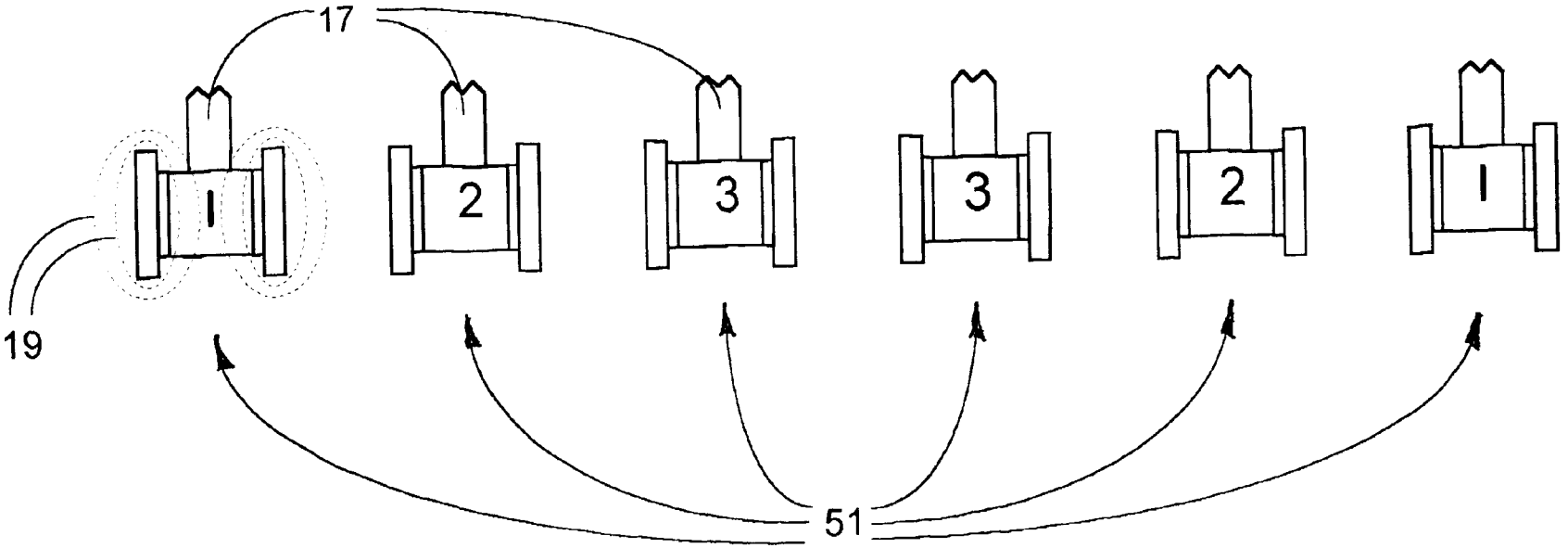
FIG. 7 illustrates one embodiment of parallel array of railguns using multiple phased AC power according to teachings of the present invention.

FIG. 7 illustrates one embodiment of a parallel array of railguns operable to displace an object or payload. Several railguns, illustrated collectively at 51, include thrust arms 17 operably coupled to displace an object or payload (not expressly shown). Magnetic field 19 may be provided by each railgun to create a force to displace an object or payload. Railguns 51 are preferably placed far enough apart so that there is enough space between them for their magnetic fields 19 to return.

FIG. 7 illustrates six railguns with power supply phases arranged as indicated by the numbers, 1, 2, 3, 3, 2, 1. A first phase is associated with the outer pair of railguns, a second phase is associated with adjacent inner pair railguns, and a third phase is associated with the inner pair of railguns. Other embodiments for configuring railguns 51 using associated single phase alternating current may be realized. For example, each phase for each railgun may be connected in the order 1, 3, 2, 2, 3, 1. As such, the forces generated by railguns 51 may be made symmetrical about a center line to reduce yawing torque associated with displacing an object using plural railguns.

During use, a selective phase may be used with each associated railgun as an armature for each railgun moves along each rail. For example, each pair may accelerate an object beginning with the phase as indicated in FIG. 7 and, along various point of each railgun, several sources may be provided at predetermined locations along an associated rail pair to provide a single phase current. As such, a parallel array of railguns using multiple phase AC power having distributed power sources may be used to displace an object.

Figure 8:
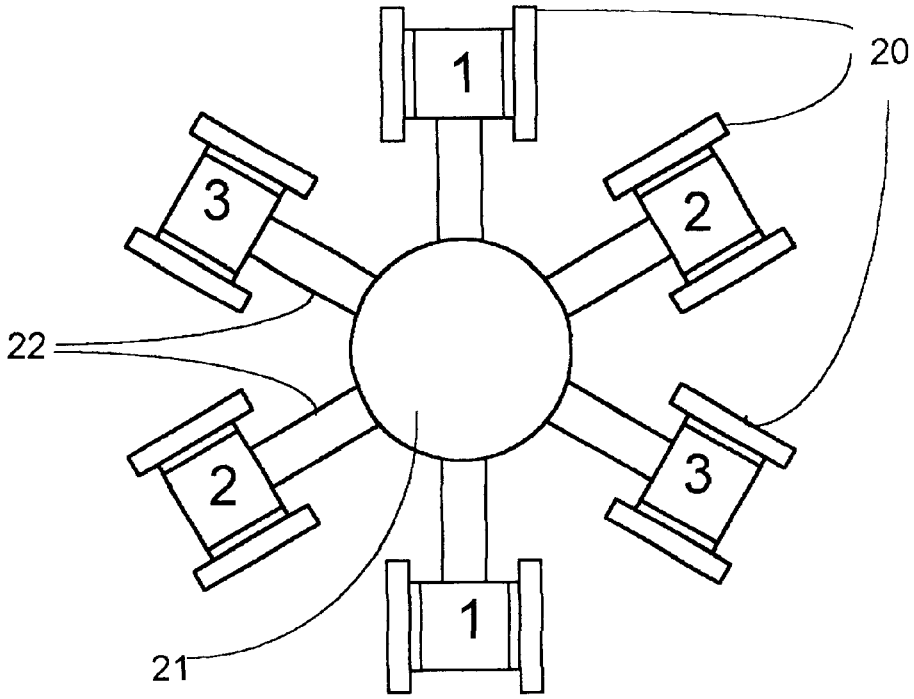
FIG. 8 illustrates one embodiment of a circular array of railguns using multiple phased AC power according to teachings of the present invention.

FIG. 8 illustrates one embodiment of a circular array of railguns operable to displace an object or payload. The circular array may be used for gun-type applications and includes several railguns 20 circularly arranged with thrust arms 22 connected to a master block 21 at their center. Railguns 20 positioned across from each other use a current having the same phase. As such, a symmetrical yaw free force on master block 21 to displace an object. During use, railguns 20 having an associated AC phased power accelerate an object coupled to master block 21 and thrust arms 22. In one embodiment, several power sources having the same phase may be provided for each railgun 20 along distributed points of each railgun 20.

Figure 9:
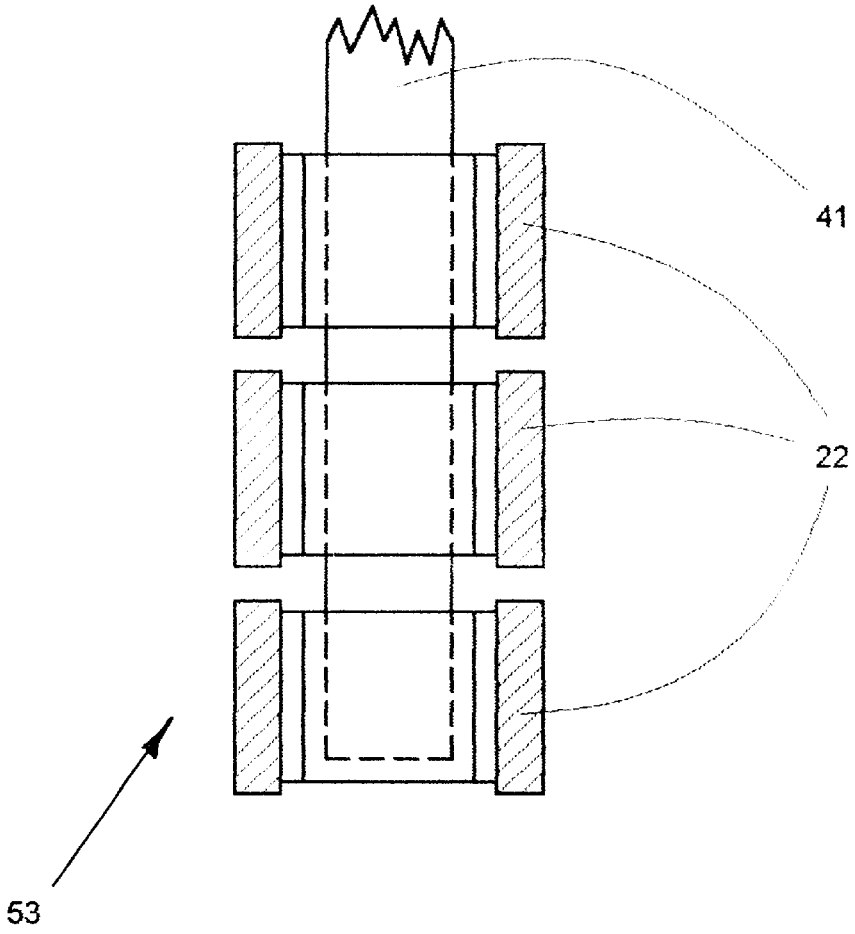
FIG. 9 illustrates one embodiment of a multi-tier railgun according to teachings of the present invention.

FIG. 9 illustrates one embodiment of a multi-tiered railgun for displacing an object or payload. A rear perspective view of a multi-tier railgun, illustrated generally at 53, includes plural railguns 22 coupled to a thrust arm 41 for displacing an object or payload (not expressly shown). Each railgun 22 may include a separate phase for accelerating thrust arm 41. Additionally, the magnitude of the current used to provide a force may contribute to a cross sectional dimension for each railgun 22. For example, a minimum rail height may be required to carry a particular magnitude of current. Higher current in general may require larger bore railguns. Additionally, if the current per unit rail height becomes too large for a square bore geometry, then rail height associated with railguns 22 may be increased. As such, through providing a multi-tier railgun the current needed to displace an object may be reduced by dividing the current among each railgun 22 in the tiered arrangement illustrated in FIG. 9.

During use, each railgun 22 may be electrically coupled in series to provide current on sub-rail basis. For example, the current for each railgun 22 may be reduced by a factor of one third of a given total current needed to produce a desired force. As such, some low velocity railguns require high voltages for displacing an object may benefit from using multi-tier railgun 53.

Figure 10:
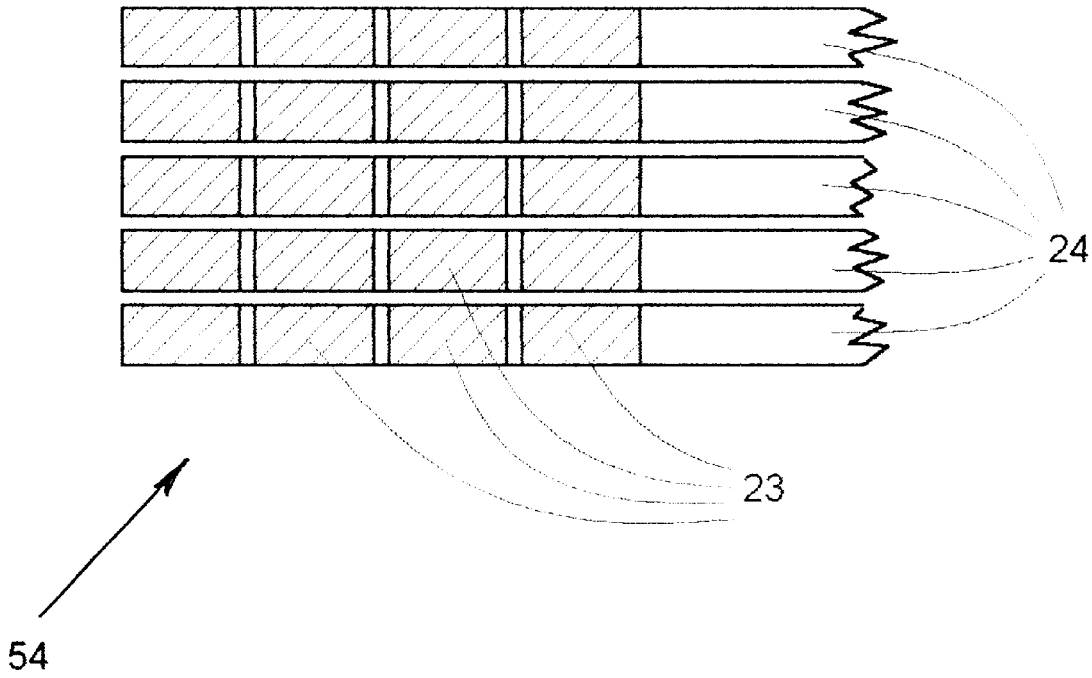
FIG. 10 illustrates one embodiment of a multi-contact armature brush array according to teachings of the present invention.

FIG. 10 illustrates one embodiment of a multi-contact armature brush array operable to contact a rail of a railgun. A multi-brush armature, illustrated generally at 54, includes several armature arms 24 including plural brush faces 23 for contacting a rail of a railgun (not expressly shown). Through using plural brushes 23 and armature arms 24, increased levels of current may be conducted thereby providing an increased force for a given current per brush to displace an object (not expressly shown). For example, if the total current needed is 100,000 amperes, then the current should be shared between 20 brushes as illustrated by multi-brush armature 54. In one embodiment, high electrical conductivity brushes which may include high conductivity materials such as copper, silver, etc., may be used to contact a railgun rail. As such, high current levels may be realized without causing sparking or arching at the interface between brush 23 and a railgun rail.

Figure 11:
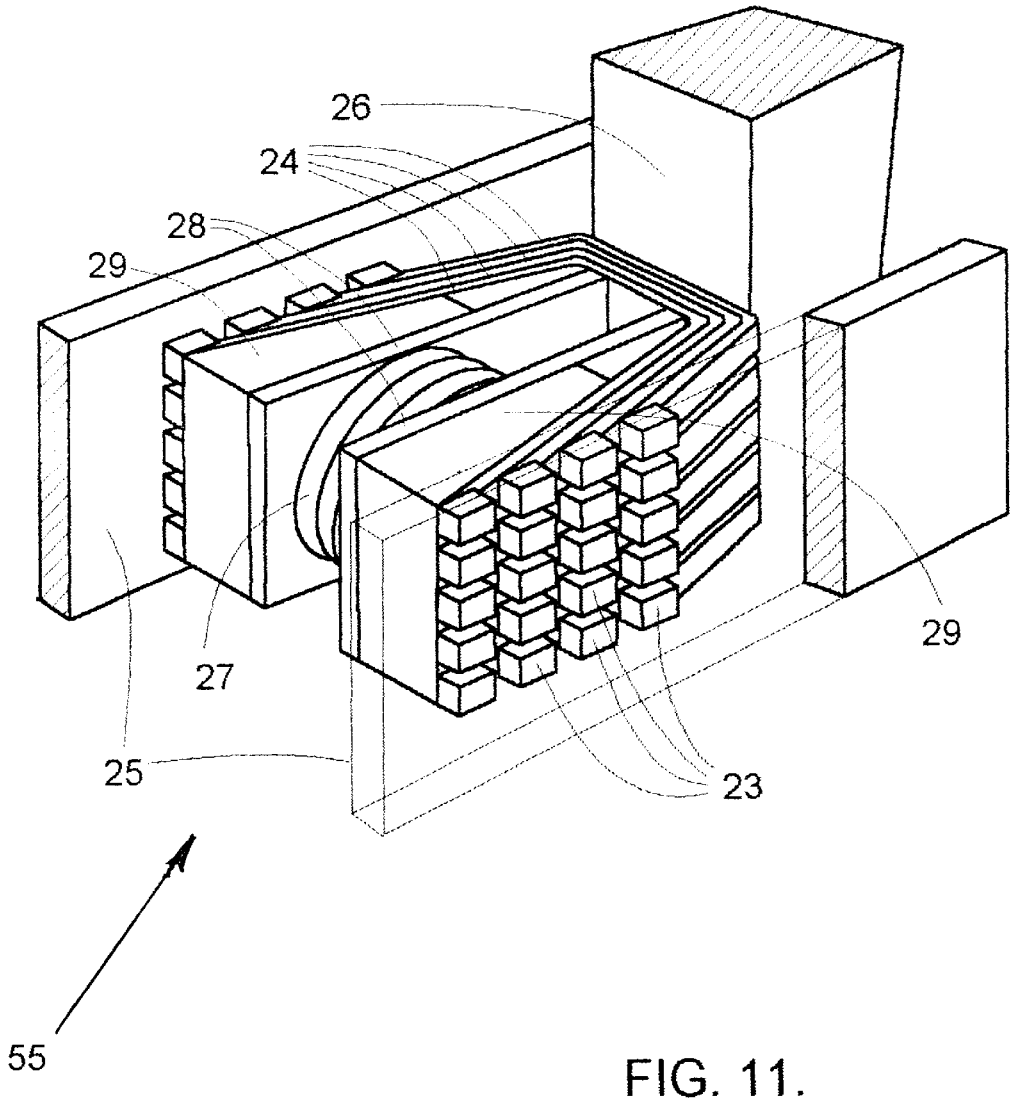
FIG. 11 illustrates one embodiment of a railgun using a multi-contact armature brush array according to teachings of the present invention.

FIG. 11 illustrates one embodiment of a railgun using a multi-contact armature brush array. A railgun, illustrated generally at 55, includes a pair of rails 25 coupled to an armature having nested armature arms 24 with plural brush faces 23. The armature assembly further includes a bellows 27 coupled to a pair of bellows feet 28 and resilient wedges 29.

During use, brush faces 23 and nested armature arms 24 conduct current between rails 25 and produce a force to move an object or payload (not expressly shown) coupled to thrust arm 26. Nested armature arms 24 are provided in a trailing manner such that forces act in the direction to hold brush faces 23 in contact with rails 25. However, as an AC signal passes through zero, the EM force for railgun 55 also approaches zero. As such, bellows 27 may provide additional force to maintain brush faces 23 in contact with rails 25. For example, bellows 27 may be cylindrically shaped and foot 28 may be attached to both end faces of bellows 27 to spread the force produced by pressure in bellows 27 to a shape and size which matches the shape and size of the brush array. In one embodiment bellows 27 may have rectangular cross section having the same shape as the brush array thereby reducing the need for foot 28.

In another embodiment, wedges 29 are made of a resilient material operable to transmit the force generated by the pressure in bellows 27 to the backs of the nested armature arms 24. A gas pressure with bellows 27 may be externally controlled (not expressly shown) so that when set to zero, the armature can be easily slid from between the rails when necessary. Contact force can be changed by changing the pressure and pressure can be increased (decreased) when brush current is increased (decreased).

In one embodiment, an expansion stop may be provided to prevent over-expansion of bellows 27 should the armature assembly exit rails 25 with pressure still in bellows 27. Bellows 27, feet 28, and wedges 29 may be coupled such that each component may move with the whole armature assembly. For example, a double-hinged coupling element (not expressly shown) may be coupled between armature arms 24 and bellows 27.

Although the present invention has been described with respect to a specific preferred embodiment thereof, various changes and modifications may be suggested to one skilled in the art and it is intended that the present invention encompass such changes and modifications fall within the scope of the appended claims.

What is claimed is:

1. A system operable to displace an object comprising:

a housing including a pair of rails operable to conduct a current;

an armature coupled between the rails and operable to conduct the current between the rails;

a thrust arm coupled to the armature and extending through a slot in the housing, the thrust arm operable to displace the object in response to the armature conducting the current and moving along the rails;

plural railguns, each railgun having an associated alternating current phase;

a master block coupled to the plural railguns via a thrust arm associated with each railgun; and the plural railguns configured in a generally circular orientation with an opposing railgun's current having the same phase.

2. A system operable to displace an object comprising:

a housing including a pair of rails operable to conduct a current;

an armature coupled between the rails and operable to conduct the current between the rails;

a thrust arm coupled to the armature and extending through a slot in the housing, the thrust arm operable to displace the object in response to the armature conducting the current and moving along the rails;

plural rail guns, each rail gun having an associated alternating current phase; and each railgun includes one phase of a three phase alternating current.

3. A system operable to displace an object comprising:

a housing including a pair of rails operable to conduct a current;

an armature coupled between the rails and operable to conduct the current between the rails;

a thrust arm coupled to the armature and extending through a slot in the housing, the thrust arm operable to displace the object in response to the armature conducting the current and moving along the rails;

distributed power sources along the rails and operable to provide a single phase alternating current; and the power sources including transformers operable to provide the single phase current based on a desired acceleration of the armature along the rails.

4. A railgun accelerator system comprising:

a plurality of railguns having a pair of rails operable to conduct a current;

a plurality of armatures positioned between the rails and operable to be displaced along the rails in response to the current;

distributed power sources positioned along the rails and operable to provide as a single phase alternating current for each railgun;

nested armature arms having one or more brushes slidingly contacting the rails; and a bellows positioned between the brush arms and operable to maintain the one or more brushes against the rails.

5. The system of claim 4, wherein the bellows includes coupling feet positioned between the bellows and the nested brush arms, the coupling feet operable to provide substantially uniform pressure of the brushes to the rails.

6. The system of claim 4, wherein the bellows is expandable to various widths.

7. The system of claim 4, wherein each railgun includes a single phase of a three phase alternating current.

8. The system of claim 4, further comprising the plurality of railguns including associated armatures operable to displace a respective thrust arm, each railgun having an associated alternating current phase.

9. The system of claim 8, wherein the plurality of railguns are positioned in a parallel orientation.

10. The system of claim 8, wherein the plurality of railguns are positioned in a multi-tiered orientation.

11. The system of claim 8, wherein the plurality of railguns are positioned in a circular orientation.

* * * * *